US007847652B1

(12) United States Patent
Chen et al.

(10) Patent No.: US 7,847,652 B1
(45) Date of Patent: Dec. 7, 2010

(54) COMPACT ORTHOMODE TRANSDUCER WITH IMPROVED CROSS-POLARIZATION ISOLATION

(75) Inventors: Ming H. Chen, Rancho Palos Verdes, CA (US); Hong Y. Tsai, Jhonghe (TW)

(73) Assignee: Victory Microwave Corporation, Hsi-Chih (TW)

( * ) Notice: Subject to any disclaimer, the term of this patent is extended or adjusted under 35 U.S.C. 154(b) by 166 days.

(21) Appl. No.: 12/235,814

(22) Filed: Sep. 23, 2008

Related U.S. Application Data

(60) Provisional application No. 61/039,808, filed on Mar. 27, 2008.

(51) Int. Cl.

| | |
|---|---|
| ***H01P 1/161*** | (2006.01) |
| ***H01P 5/12*** | (2006.01) |
| ***H01P 1/209*** | (2006.01) |
| ***H01P 1/213*** | (2006.01) |
| ***H01P 11/00*** | (2006.01) |

(52) U.S. Cl. ..... 333/21 A; 333/135; 333/137; 333/126; 29/600

(58) Field of Classification Search ..... 333/125, 333/126, 135, 137, 21 A; 29/600
See application file for complete search history.

(56) References Cited

U.S. PATENT DOCUMENTS 3,210,693 A * 10/1965 De Vos et al. ..... 333/125
4,920,351 A * 4/1990 Bartlett et al. ..... 343/756
5,739,734 A 4/1998 Chen et al.
5,923,229 A * 7/1999 Simons ..... 333/135
6,621,375 B2 * 9/2003 Vezmar et al. ..... 333/125
6,842,085 B2 * 1/2005 Chen et al. ..... 333/125
6,847,270 B2 * 1/2005 Yoneda et al. ..... 333/135
7,408,427 B1 * 8/2008 Lee-Yow et al. ..... 333/126

OTHER PUBLICATIONS

Wollack, E., "A Full Waveguide Band Orthomode Junction" 1996 NRAO, EDIR Meme Series, #303.

* cited by examiner

*Primary Examiner*—Barbara Summons
(74) *Attorney, Agent, or Firm*—Clifford B. Perry

(57) ABSTRACT

An orthomode transducer includes first, second and third waveguide sections. The first waveguide section is coupled to an antenna port and extends to a first port. The first waveguide section is configured to support the propagation of a signal having a first polarization. The second waveguide section is configured to support the propagation of a signal having a second polarization which is substantially orthogonal to the first polarization. The second waveguide section is coupled to the antenna port and extends to a second port. The second waveguide section further includes a plurality of filter elements. The third waveguide section includes a port coupled to the antenna port, and is configured to support the propagation of the signal having the second polarization. The third waveguide section includes at least one filter element, whereby the number of second waveguide section filter elements is greater than the number of the at least one third waveguide section filter elements.

23 Claims, 7 Drawing Sheets

COMPACT ORTHOMODE TRANSDUCER WITH IMPROVED CROSS-POLARIZATION ISOLATION

CROSS REFERENCE TO RELATED APPLICATIONS

This application claims the benefit of priority of U.S. provisional application No. 61/039,808, filed Mar. 27, 2008, and entitled "Compact OMT with Improved Cross Polarization Isolation," the contents of which are herein incorporated by reference in its entirety for all purposes.

FIELD OF THE INVENTION

The present invention relates to orthomode transducers, and more particularly to a compact orthomode transducer architecture which provides improved cross-polarization isolation.

BACKGROUND

Cross-polarization isolation in satellite communication systems has becomes especially important in recent times, as an increasing number of systems implement the use of multiple signal polarizations (e.g., vertical and horizontal) to expand their communication capacity. Unfortunately, the cross polarization component of the signal will cause interference between the orthogonally polarized channels, e.g., between vertical and horizontal polarized channels. Minimization of this type of signal degradation is therefore desirable. The main source of cross polarization is in the feed system, namely the orthomode transducer (OMT). Accordingly, reducing the cross polarization in the OMT is an important task in ground systems design.

The source of the cross polarization component is the coupling via higher order modes in the OMT junction. Although those higher order modes are cut-off modes, they still act as a bridge to couple vertical and horizontal polarizations. A design with fewer higher order modes produced will result in less cross polarization coupling and, higher cross polarization isolation.

In practice, an OMT in the feed network is usually designed with a transmit reject filter (TRF) at the Rx port to reject the Tx signal at the Rx channel. It is preferable that the TRF be positioned close to the junction for easier OMT matching. The TRF may be designed as a band reject filter with multiple cavities. U.S. Pat. No. 5,739,734 entitled "Evanescent Mode Band Reject Filters and Related Methods" discloses an exemplary design of such filters.

FIG. 1A illustrates a conventional three-port OMT device 100. The three-port OMT includes a first waveguide section 120 coupled between an antenna (Ant) port 112 and a transmit (Tx) port 122, and a second waveguide section 130 coupled between the Ant port 112 and a receive (Rx) port 132. The TRF 134 is disposed within the second waveguide section 130. The common junction of the three port device is an asymmetrical junction, and it will produce many higher order modes.

FIG. 1B illustrates the conventional three-port OMT separated into half sections 100*a* and 100*b*, as shown. The aforementioned features are shown as having "a" and "b" counterparts, corresponding to half a or half b of the OMT 100, as shown. The TRF half 134*a* includes cavities for rejecting the Tx signal propagating within the Rx waveguide section 130.

FIG. 2A illustrates a conventional four-port OMT with symmetrical junctions 200. In this form, the four-port OMT 200 includes a first waveguide section 220 coupled between the Ant port 212 and a Tx port 222, a second waveguide section 230 coupled between the Ant port 212 and a first Rx port 232, and a third waveguide section 240 coupled between the Ant port 212 and a second Rx port 242. Conventionally, the second and third waveguides 230 and 240 are symmetrical, including implementation of matching TRF structures 234 and 244 in waveguide sections 230 and 240, respectively.

FIG. 2B illustrates the OMT 200 separated into half sections 200*a* and 200*b*, as shown. The aforementioned features are shown as having "a" and "b" counterparts, corresponding to half a or half b of the OMT 200, as shown. The TRF halves 234*a* and 234*a* include cavities for rejecting the Tx signal propagating within each of the Rx waveguide sections 240 and 250.

The four port OMT 200 excites fewer higher order modes due to the symmetry of its structure. Consequently, higher cross polarization isolation can be achieved. Disadvantageously, the two Rx ports 232 and 242 will require signal combining with a power combiner (not shown) to receive all components of the signal from satellite without any signal loss. An example of such a structure is disclosed by Wollack, E., in "A Full Waveguide Band Orthomode Junction" 1996 NRAO, EDIR Meme Series, #303. However, the overall network is cumbersome, and is not suitable to be used in a practical feed network.

Accordingly, what is needed is an orthomode transducer having improved cross polarization isolation similar to that provided by a larger symmetrical OMT, but which is of a compact size similar to the asymmetrical OMT.

SUMMARY

An OMT architecture is presented which combines the small size of an asymmetric OMT with the high cross-polarization isolation of a larger, symmetrical OMT. The described OMT employs a smaller waveguide section that emulates a larger waveguide section of the OMT, thereby providing an OMT having substantially the performance characteristics of a symmetrical OMT having the footprint of an asymmetrical OMT.

In one embodiment, the OMT includes first, second, and third waveguide sections. The first waveguide section is coupled to an antenna port and extends to a first port. The first waveguide section is configured to support the propagation of a signal having a first polarization. The second waveguide section is configured to support the propagation of a signal having a second polarization which is substantially orthogonal to the first polarization. The second waveguide section is coupled to the antenna port and extends to a second port. The second waveguide section further includes a plurality of filter elements. The third waveguide section includes a port that is coupled to the antenna port, the third waveguide section configured to support the propagation of the signal having the second polarization. The third waveguide section includes at least one filter element, whereby the number of second waveguide section filter elements is greater than the number of at least one third waveguide section filter elements.

These and other features of the invention will be better understood in view of the following detailed description and drawings.

For clarity, previously identified features retain their reference indicia in subsequent drawings.

DETAILED DESCRIPTION OF EXEMPLARY EMBODIMENTS

Figure 1A:
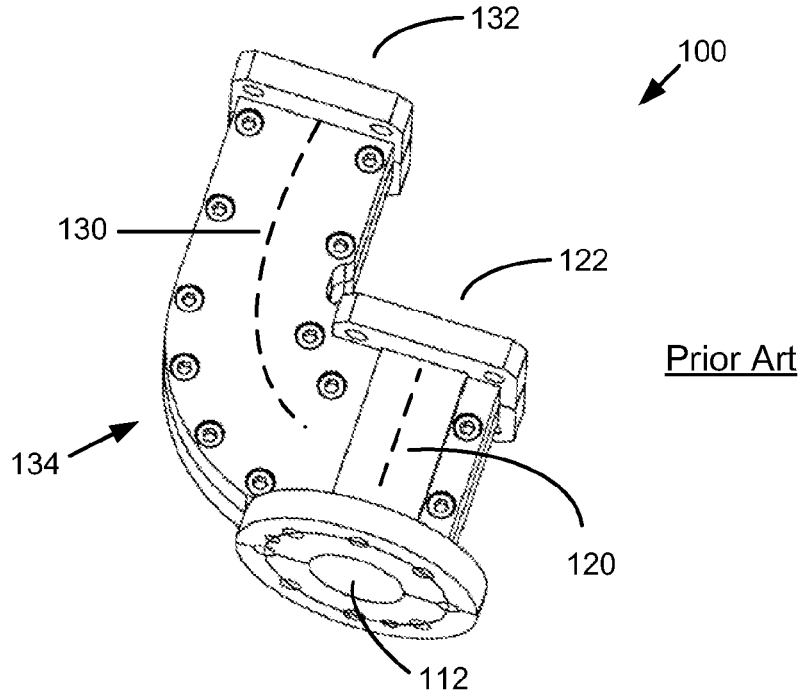
FIG. 1A illustrates a conventional three-port OMT device known in the art.
Figure 1B:
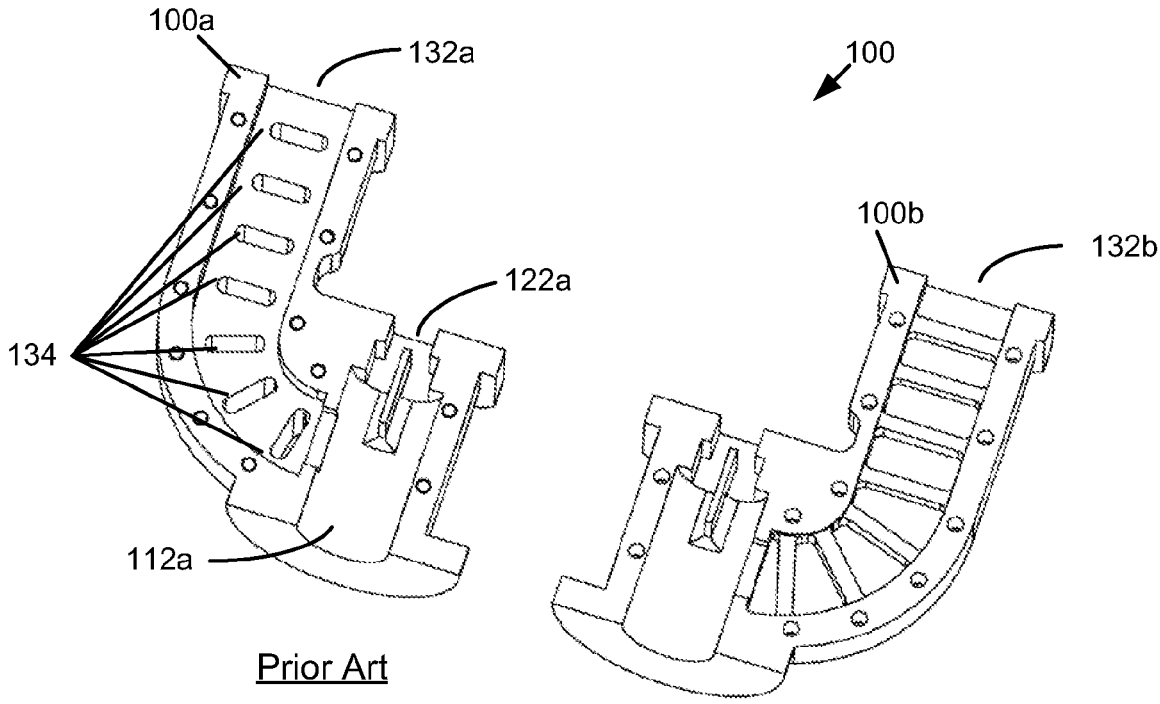
FIG. 1B illustrates the OMT of FIG. 1A separated into half sections.
Figure 2A:
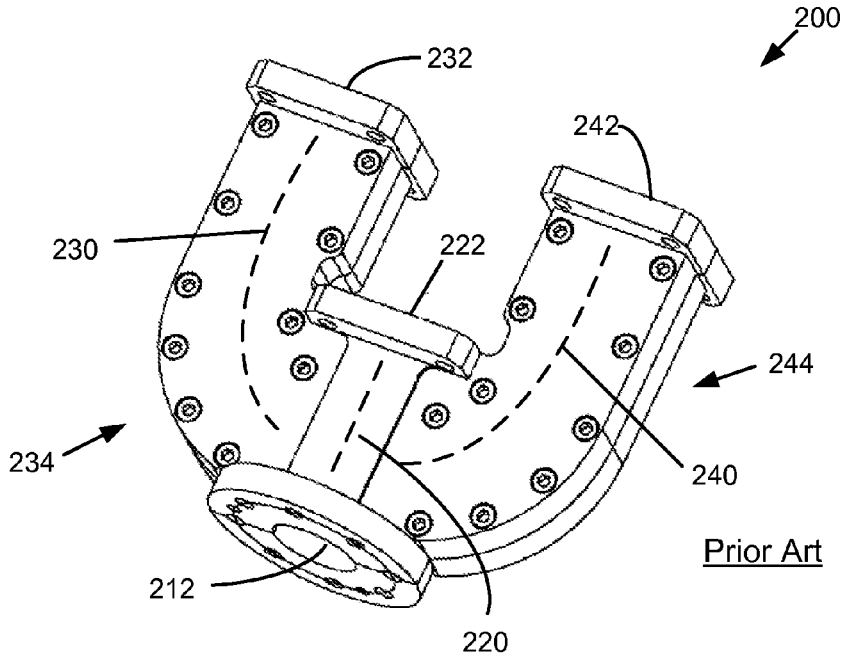
FIG. 2A illustrates a conventional four-port OMT with symmetrical junctions known in the art.
Figure 2B:
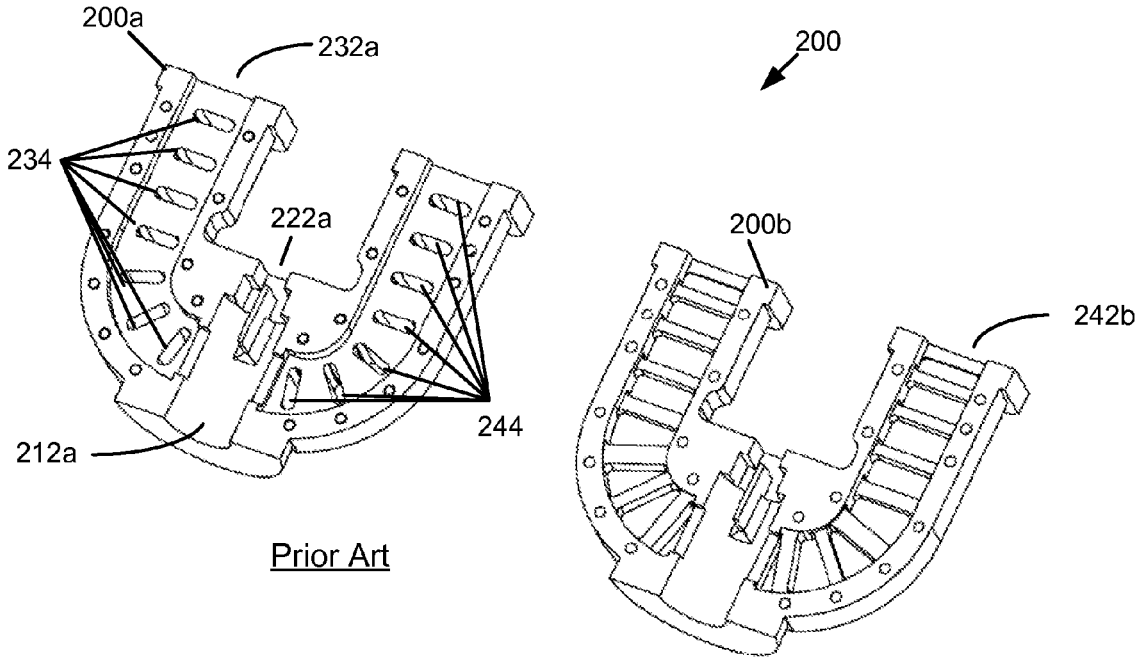
FIG. 2B illustrates the OMT of FIG. 2A separated into half sections.
Figure 3A:
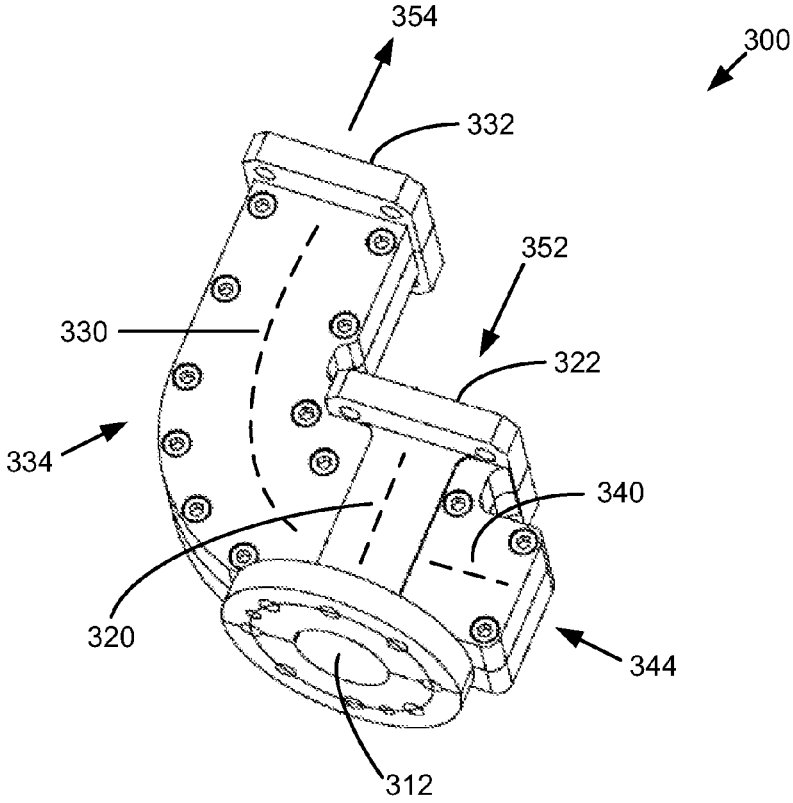
FIG. 3A illustrates an exemplary compact OMT with improved cross-polarization isolation in accordance with the present invention.

FIG. 3A illustrates an exemplary compact OMT 300 in accordance with the invention. The OMT 300 includes first, second, and third waveguide sections 320, 330, and 340. The first waveguide section 320 is coupled to an antenna (Ant) port 312 and extends to a Transmit (Tx) port 322. The first waveguide section 320 is configured to support the propagation of a signal having a first polarization, e.g., a transmit signal 352 in the frequency range of 13.75 GHz-14.5 GHz having a vertical polarization. As understood by the skilled person, the first waveguide section 320 can be dimensioned to support the propagation of a signal operating at other frequencies and/or different polarizations.

The second waveguide section 330 is coupled to the Ant port 312 and extends to a second (Rx) port 332, and is configured to support the propagation of a signal having a second polarization which is substantially orthogonal to the first polarization. Continuing with the aforementioned exemplary embodiment, the second waveguide section 330 is configured to support the propagation of a received signal 354 having a horizontal polarization operating within the frequency band of 10.7 GHz to 12.75 GHz. As above, the second waveguide section 330 may be alternatively sized to support the propagation of a signal operating at any particular frequency, as well as any polarization (e.g., linear, circular, elliptical) that is substantially orthogonal to the first signal.

Further particularly, the second waveguide section 330 further includes a plurality of filter elements 334, further illustrated below. The term "filter element" refers to a structure operable to provide a frequency-selective response consistent with that of a band reject filter response, a band pass filter response, a low pass filter response, or a high pass filter response. Exemplary filter elements include a short-circuit cavity, a stub, a stepped waveguide cross-sectional area, a septum structure, and the like. In a specific embodiment further illustrated below, the plurality of filter elements comprise band reject filter elements which collectively operate to provide a transmit reject filter structure.

The third waveguide section 340 is coupled to the Ant port 312, the third waveguide section 340 being configured to support the propagation of the signal having the second polarization, e.g., a horizontally polarized signal operating in the 10.7-12.75 GHz frequency range, i.e., received signal 354. The third waveguide section 340 is a one-port waveguide section, and includes at least one filter element 344 (further described and illustrated below), whereby the number of second waveguide section filter elements 334 is greater than the number of the third waveguide section filter elements 344. Even more particularly, each of the second and third waveguide filter elements 334 and 344 are of the same type, e.g., band reject filter elements.

Figure 3B:
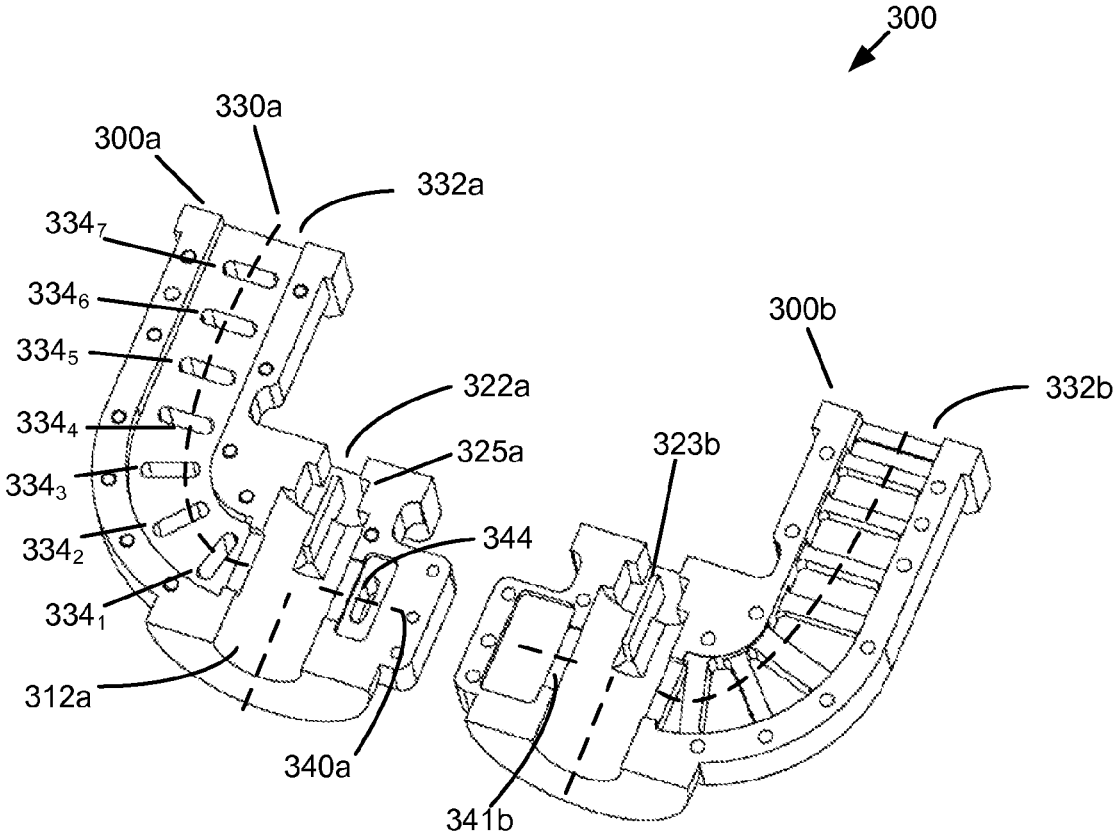
FIG. 3B illustrates the OMT of FIG. 3A separated into half sections.

FIG. 3B illustrates the improved OMT 300 separated into two half sections 300*a* and 300*b*. The first waveguide section 320 includes a septum 323 and a stepped tapered section 325, each preferably sized to provide the lowest signal loss over the Tx band of operation. In a particular embodiment, the septum 323 and stepped tapered section 325 are shaped (e.g., tapered) to permit casting, as will be further described below.

The second waveguide section 330 (indicated by broken line) includes a plurality of filter elements $\mathbf{334}_1$-$\mathbf{334}_7$, exemplary shown as seven filter elements which collectively form a transmit reject filter (TRF) structure 334. In the described exemplary embodiment, each of the filter elements $\mathbf{334}_1$-$\mathbf{334}_7$ is a band reject filter elements, each formed by a short-circuited cavity of particular dimensions, and the collective plurality of filter elements $\mathbf{334}_1$-$\mathbf{334}_7$ operate to provide a band reject response, attenuating the transmit signal 352 within the second waveguide section 330 to a predefined level. Each band reject filter element $\mathbf{334}_1$-$\mathbf{334}_7$ is a short-circuited cavity which measures 11.0×3.50×14.0 mm in slot length, width, and depth dimensions, respectively, to provide band reject response for a desired frequency range, e.g., over the 13.75 GHz-14.5 GHz range of the transmit signal 352. In other embodiments, the filter elements 334 may be band pass filter elements, low pass filter elements, high pass filter elements, or a combination of different filter elements. Further, any number of filter elements may be employed, e.g., to provide a desired level of filtering/attenuation.

The third waveguide section 340 (indicated by broken line) is a one-port waveguide section, and includes a port 341 that is coupled to the Ant port 312, and at least one filter element 344, whereby the number of second waveguide section filter elements 334 (seven shown) is greater than the number of the third waveguide section filter elements 344 (one shown). Even more particularly, each of the second and third waveguide filter elements 334 and 344 are of the same type, e.g., band reject filter elements.

The implementation of a different number of filter elements in the second and third waveguide sections 330 and 340 will result in signal responses (e.g., transmitted and reflected scattering parameter responses) which are different when looking into each of the second and third waveguide sections from the Ant port 312. As a result, some signal imbalance at the Ant port 312 will be created, which can degrade cross-polarization isolation of the OMT, particular over the Tx frequency range, as signals within this frequency range (13.75 GHz-14.5 GHz) are less attenuated to the evanescent modes (the cut off higher order modes) than the signals of the second waveguide section 330 (operable over 10.7 GHz-12.75 GHz). Because signals within the Tx frequency range (exemplary 13.75-14.5 GHz) are less attenuated than the Rx frequency range signals, the Tx frequency signal can be coupled easily through the second and third waveguide sections 330 and 340.

In order to reduce this imbalance and improve cross-polarization isolation, the dimensions of the third waveguide section filter element 344 may be modified while monitoring the cross-polarization performance of the OMT until the desired level of cross-polarization performance is achieved. Those skilled in the art will appreciate that the first filter element within each of the first and second waveguide sections 330 and 340 will largely define the signal response of each of the second and third waveguide sections, and thus, only one filter element 344 will be needed within the third waveguide section 340 in many embodiments in order to achieve a sufficient amount of balance in the signal responses of the two waveguide sections, and correspondingly, the desired amount of cross-polarization isolation will in many cases be achieved in this embodiment. However, additional third waveguide filter elements 344 may be implemented in order to improve the cross-polarization isolation further. Any number of third waveguide filter elements 344 may be used, the total number being at most, one fewer than the number of second waveguide filter elements 334. In a particular embodiment, the dimensions of the third waveguide filter element 344 are modified, starting from the dimensions of the filter elements 334, to the final dimensions of 11.0 mm×3.10 mm×7.0 mm (slot length, width, and depth) to achieve the desired level of cross-polarization isolation over the Tx band as measured between ports 312 and 322 of the first waveguide section 320, as shown in FIG. 4B, below.

Figure 3C:
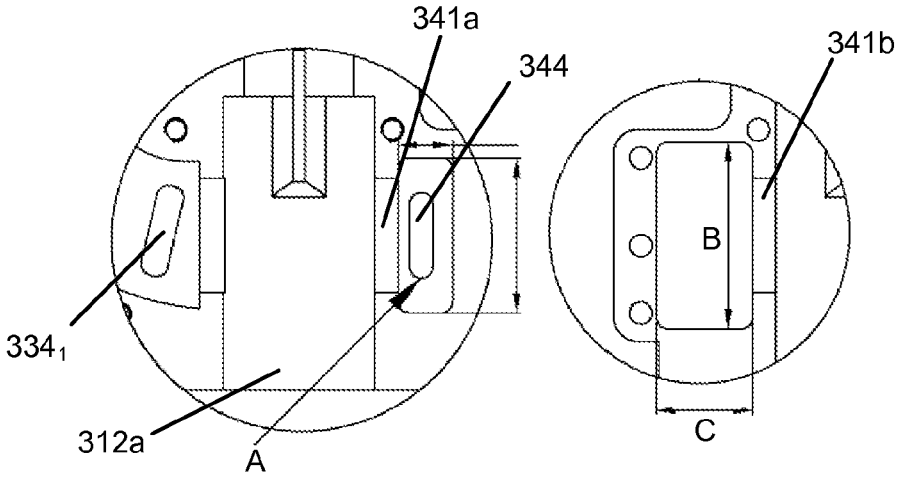
FIG. 3C illustrates details of the third waveguide section of the OMT shown in FIG. 3A.

FIG. 3C illustrates details of the third waveguide section of the OMT shown in FIG. 3A. In a particular embodiment of the invention, the third waveguide filter element 344 is a short-circuited cavity having dimensions 11.0×3.10×7.0 mm of cavity length, width, and depth (dimension A). Further exemplary, filter element 344 is enclosed by a cap of dimensions 24.10×12.75 mm (dimensions B×C).

As noted above, the interference from the higher order modes (the cut off modes) is typically more problematic at the frequencies closer to the cut-off frequencies, i.e. the higher frequencies would have more interference than the lower frequencies from the higher order modes. As a result, the Tx band experiences a higher level of cross polarization interference than the Rx band from the higher orders modes because the Tx band is at higher frequencies than the Rx band in the ground terminal, thus the Tx band may require higher attenuation on cross-polarization isolation than the lower frequency Rx band.

Figure 3D:
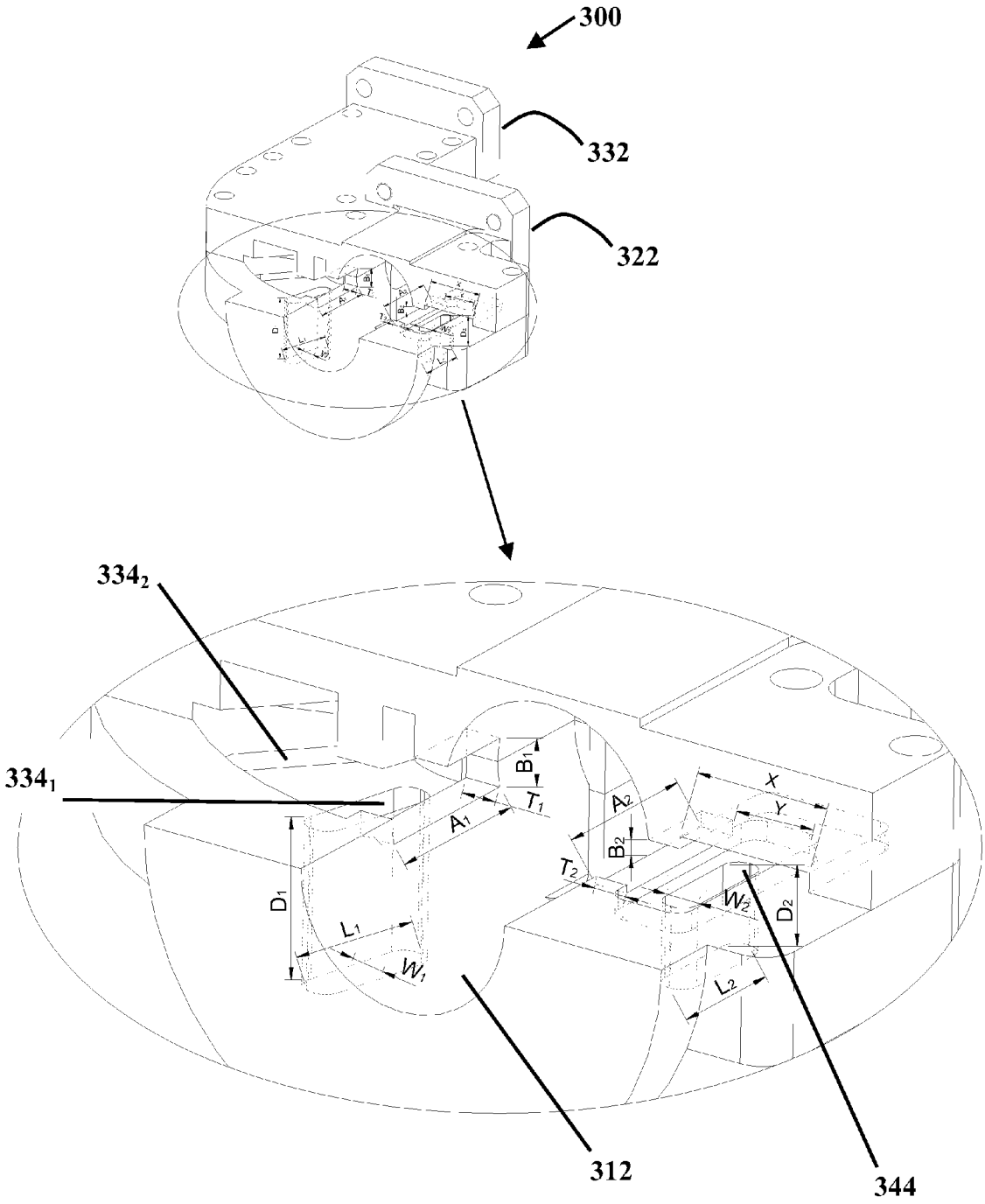
FIG. 3D illustrates a perspective view of the OMT of FIG. 3A

FIG. 3D illustrates a perspective view of the OMT of FIG. 3A, with previously-identified features retaining their reference indicia. The view illustrates sections $\mathbf{334}_1$ and $\mathbf{334}_2$ of the TRF in the second waveguide section, and the filter element 344 in the third waveguide section. The Ant port 312, the Tx port 322, and the Rx port 332 are also shown. In a particular embodiment of the invention in which the Rx and Tx bands are 10.7-12.75 GHz and 13.75-14.75 GHz, respectively, $A_1$=14.7 mm, $B_1$=4.2 mm, $T_1$=3.23 mm, $L_1$=11.9 mm, $D_1$=14.0 mm, $W_1$=3.5 mm, $A_2$=14.7 mm, $B_2$=1.34 mm, $T_1$=3.02 mm, $L_2$=11.0 mm, $D_2$=7.0 mm, $W_2$=3.1 mm, X=12.5 mm, and Y=7.1 mm.

Figure 4A:
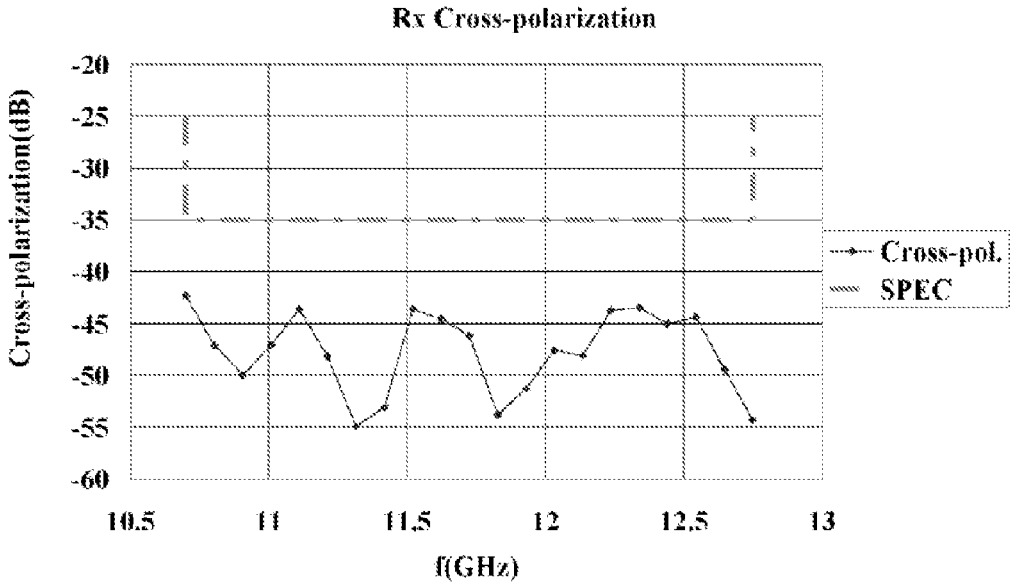
FIG. 4A illustrates the cross-polarization isolation of an exemplary compact OMT over an exemplary receive band of 10.7 GHz to 12.75 GHz.
Figure 4B:
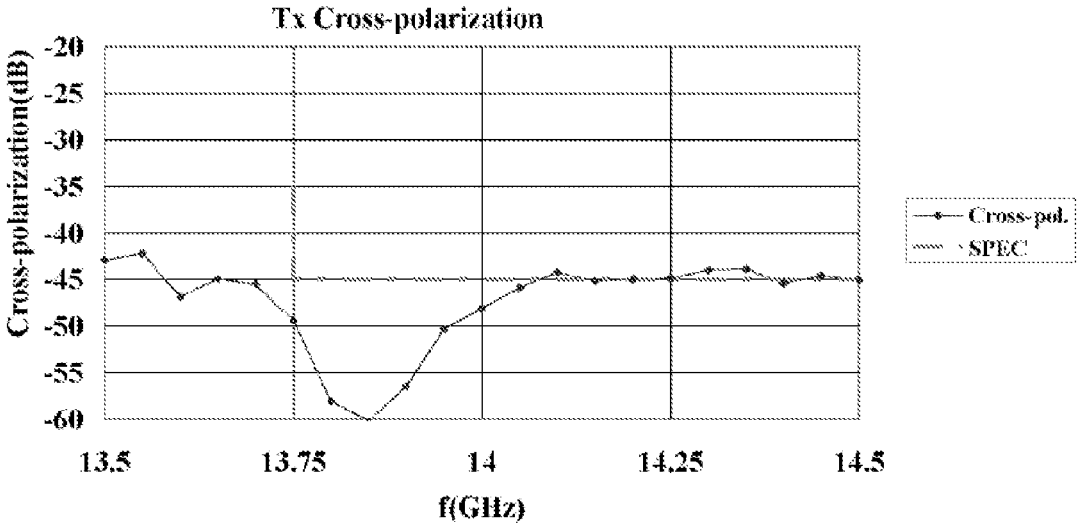
FIG. 4B illustrates the cross-polarization isolation of an exemplary compact OMT over an exemplary transmit band of 13.75 GHz to 14.5 GHz.

FIG. 4A illustrates the cross-polarization isolation of an exemplary compact OMT over an exemplary receive band of 10.7 GHz to 12.75 GHz. The compact OMT 300 provides generally −35 dB of cross-polarization isolation over the receive band.

FIG. 4B illustrates the cross-polarization isolation of an exemplary compact OMT over an exemplary transmit band of 13.75 GHz to 14.5 GHz. The compact OMT 300 provides generally −45 dB of cross-polarization isolation over the receive band.

The skilled person will appreciate that the same OMT architecture of different dimensions can be used to provide a compact OMT operable over a different Tx and RX frequency range. Since the third waveguide section 340 operates as a one port waveguide section, the need of a power combiner is obviated, and a highly compact OMT with high cross polarization is thereby achieved.

The OMT 300 of the present invention may be manufactured from a variety of materials used in the construction of waveguide components. Such materials include aluminum, copper, brass, and Kovar, and other materials (possibly plated) which are commonly used in the microwave frequency component manufacture. Techniques for manufacturing the OMT of the present invention would include the conventional processes of precision machining the OMT (usually by a numerically controlled machine) to the desired dimensions. High frequency components often require precision machining due to the very tight tolerances needed for high frequency operation. However, precision machining is expensive and an alternative technique is to cast the structure. Casting represents a substantially lower cost method of manufacturing since once a final mold is made, each part may be fabricated quickly and inexpensively in contrast to the time, skilled labor and machinery need to machine each part.

Casting, however, requires tapering portions of the structure to allow placement and removal of molds with the structure. However, high frequency structures such as the OMT of the present invention are generally designed assuming substantially straight edges and corners. Consequently, the introduction of tapered edges and corners will alter the performance of the structure, usually resulting in degraded performance.

Figure 5:
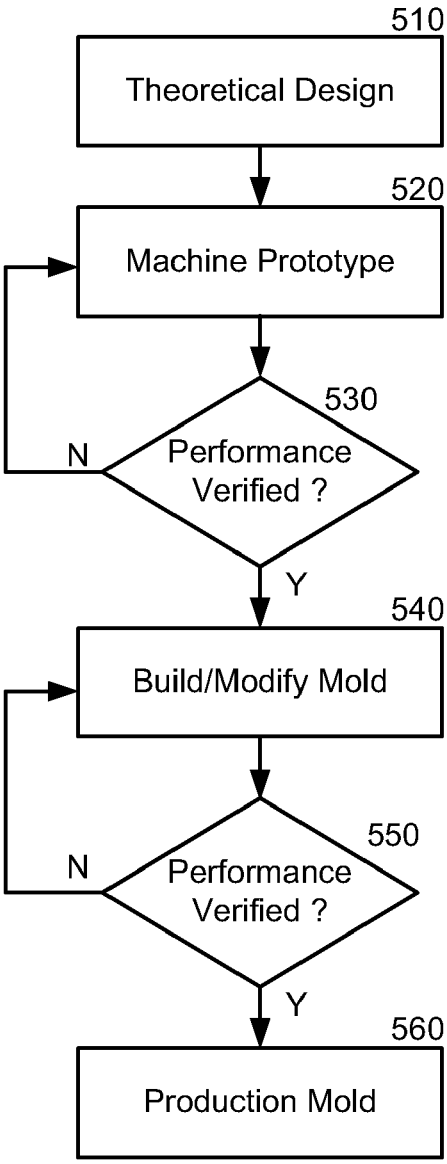
FIG. 5 illustrates an exemplary method for manufacturing an OMT in accordance with the present invention.

FIG. 5 illustrates a method of manufacturing the orthomode transducer of the present invention by using casting techniques. Initially at operation 510, a theoretical design of the OMT is developed using conventionally known techniques (e.g., three dimensional circuit simulation tools such as HFSS available from Agilent Technologies of Palo Alto, Calif.). Once the theoretical design is finalized, a prototype is fabricated (e.g., precision machined (operation 520) using conventionally known techniques such a numerically controlled machining.

Once machined, the measured performance of the prototype is compared with the simulated performance (operation 530). In one embodiment, the process is performed by comparing the measured and simulated cross-polarization responses of the OMT. If the measured performance is within an acceptance window relative to the desired performance, a casting mold of the OMT is made (operation 540). The casting mold is substantially similar to the engineering drawings of the machined structure, possible exceptions being that the internal walls, cavity walls, and septum thickness are tapered to allow placement and removal of the casting mold.

Subsequently, the cast OMT is formed and its performance measured (operation 550). If the measured performance is within a predefined window of the desired performance, the casting mold becomes the production mold from which additional OMTs are manufactured (operation 560). In a particular embodiment of 500, operation 560 comprises manufacturing the cast OMTs in aluminum.

If the measured response of the OMT is not within a predefined range of the desired response, operations 540 and 550 are repeated in which casting molds are modified and the OMT re-cast. In a particular embodiment of this process, if the measured cross-polarization response of the cast OMT is not within a predefined range of the desired cross-polarization response, operations 540 and 550 are repeated, particularly modifying parameters of the cavity, e.g., the cavity length, width and/or depth. Operation 500 continues in this manner until the measured performance of the cast OMT is within the acceptable range of the desired performance. The resulting molds are then used as the production molds to fabricate the number of OMTs required.

As readily appreciated by those skilled in the art, the described processes and operations may be implemented in hardware, software, firmware or a combination of these implementations as appropriate. In addition, some or all of the described processes and operations may be implemented as computer readable instruction code resident on a computer readable medium, the instruction code operable to control a computer of other such programmable device to carry out the intended functions. The computer readable medium on which the instruction code resides may take various forms, for example, a removable disk, volatile or non-volatile memory, etc., or a carrier signal which has been impressed with a modulating signal, the modulating signal corresponding to instructions for carrying out the described operations.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serve to refer to one exemplary embodiment of a claimed feature, and the claimed feature is not limited to the particular embodiment referred to by the reference indicia. The scope of the clamed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. An orthomode transducer, comprising:

a first waveguide section configured to support the propagation of a signal having a first polarization, the first waveguide section coupled to an antenna port and extending to a first port;

a second waveguide section configured to support the propagation of a signal having a second polarization which is substantially orthogonal to the first polarization, the second waveguide section coupled to the antenna port and extending to a second port, the second waveguide section including a plurality of second waveguide filter elements; and a third waveguide section configured to support the propagation of the signal having the second polarization, the third waveguide section having a port coupled to the antenna port, the third waveguide section comprising at least one third waveguide filter element, wherein the number of second waveguide filter elements is greater than the number of third waveguide filter elements.

2. The orthomode transducer of claim 1, wherein the at least one third waveguide filter element comprises a single filter element.

3. The orthomode transducer of claim 1, wherein the third waveguide section comprises a single port coupled to the antenna port.

4. The orthomode transducer of claim 1, wherein each of the plurality of second waveguide filter elements and the at least one third waveguide filter element are selected from the group consisting of a band reject filter element, a bandpass filter element, a low pass filter element, and a high pass filter element.

5. The orthomode transducer of claim 1, wherein each of the plurality of second waveguide filter elements and the at least one third waveguide filter element comprises a band reject filter element.

6. The orthomode transducer of claim 1, wherein the plurality of second waveguide filter elements comprise a multi-section transmit reject filter, and wherein the at least one third waveguide section filter element comprises a one section transmit reject filter.

7. The orthomode transducer of claim 1, wherein the first waveguide section is operable to support a signal within the band of 13.75 GHz-14.5 GHz.

8. The orthomode transducer of claim 1, wherein the second waveguide section is operable to support a signal within the band of 10.7 GHz-12.75 GHz.

9. The orthomode transducer of claim 1, wherein each of the first, second and third waveguide sections are integrally formed in machined aluminum, brass, copper, or Kovar.

10. An orthomode transducer, comprising:

a first waveguide section configured to support the propagation of a signal having a first polarization, the first waveguide section coupled to an antenna port and extending to a first port;

a second waveguide section configured to support the propagation of a signal having a second polarization which is substantially orthogonal to the first polarization, the second waveguide section coupled to the antenna port and extending to a second port, the second waveguide section including a plurality of second waveguide filter elements; and a third waveguide section configured to support the propagation of the signal having the second polarization, the third waveguide section having a single port coupled to the antenna port, the third waveguide section comprising at least one third waveguide filter element, wherein the number of second waveguide filter elements is greater than the number of the at least one third waveguide filter elements.

11. The orthomode transducer of claim 10, wherein the at least one third waveguide filter element comprises a single filter element.

12. The orthomode transducer of claim 10, wherein each of the plurality of second waveguide filter elements and the at least one third waveguide filter element are selected from the group consisting of a band reject filter element, a bandpass filter element, a low pass filter element, and a high pass filter element.

13. The orthomode transducer of claim 10, wherein each of the plurality of second waveguide filter elements and the at least one third waveguide filter element comprises a band reject filter element.

14. A method for fabricating an orthomode transducer, the method comprising:

developing a design of the orthomode transducer having a desired cross-polarization response, the design of the orthomode transducer including:

a first waveguide section configured to support the propagation of a signal having a first polarization, the first waveguide section coupled to an antenna port and extending to a first port;

a second waveguide section configured to support the propagation of a signal having a second polarization which is substantially orthogonal to the first polarization, the second waveguide section coupled to the antenna port and extending to a second port, the second waveguide section including a plurality of second waveguide filter elements; and a third waveguide section configured to support the propagation of the signal having the second polarization, the third waveguide section having a port coupled to the antenna port, the third waveguide section comprising at least one third waveguide filter element, wherein the number of second waveguide filter elements is greater than the number of the at least one third waveguide filter elements;

fabricating an orthomode transducer prototype based upon the developed design;

verifying the performance of the fabricated orthomode transducer prototype;

generating a casting negative based on the fabricated orthomode transducer prototype; and fabricating a cast orthomode transducer prototype.

15. The method of claim 14, wherein the at least one third waveguide filter element comprises a single filter element.

16. The method of claim 14, wherein the third waveguide section comprises a single port coupled to the antenna port.

17. The method of claim 14, wherein each of the plurality of second waveguide filter elements and the at least one third waveguide filter element are selected from the group consisting of a band reject filter element, a bandpass filter element, a low pass filter element, and a high pass filter element.

18. The method of claim 14, wherein each of the plurality of second waveguide filter elements and the at least one third waveguide filter element comprises a band reject filter element.

19. The method of claim 14, wherein the plurality of second waveguide filter elements comprise a multi-section transmit reject filter, and wherein the at least one third waveguide section filter element comprises a one section transmit reject filter.

20. The method of claim 14, wherein the first waveguide section is operable to support a signal within the band of 13.75 GHz-14.5 GHz.

21. The method of claim 14, wherein the second waveguide section is operable to support a signal within the band of 10.7 GHz-12.75 GHz.

22. The method of claim 14, wherein fabricating a cast orthomode transducer prototype comprises fabricating the orthomode transducer in aluminum, brass, copper, or Kovar.

23. The method of claim 14, further comprising:

measuring the cross-polarization response of the fabricated orthomode transducer prototype; and if the measured cross-polarization response is not within a predefined range of a desired cross-polarization response, repeating the operations of developing a design of the orthomode transducer and fabricating an orthomode transducer prototype.

* * * * *